US006490425B2

(12) United States Patent
Konday et al.

(10) Patent No.: US 6,490,425 B2
(45) Date of Patent: Dec. 3, 2002

(54) DEVICE FOR MANUAL REPLACEMENT AND TRANSPORT OF THE ROLLER OF A COPYING MACHINE OR AN ELECTROPHOTOGRAPHIC PRINTER

(75) Inventors: Andreas Konday, Deggingen (DE); Peter Schmidt, Geislingen (DE); Markus Weber, Aichwald (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/850,513

(22) Filed: May 7, 2001

(65) Prior Publication Data

US 2002/0025189 A1 Feb. 28, 2002

(30) Foreign Application Priority Data

May 17, 2000 (DE) ..... 100 23 715

(51) Int. Cl.[7] ..... G03G 15/20
(52) U.S. Cl. ..... 399/107; 206/389; 399/122
(58) Field of Search ..... 399/107, 108, 399/110, 111, 115, 116, 117, 119, 121, 122, 123; 206/303, 316.1, 389

(56) References Cited

U.S. PATENT DOCUMENTS 3,888,577 A * 6/1975 Meyer ..... 399/116
4,806,970 A * 2/1989 Nakatomi et al. ..... 399/122
4,888,620 A * 12/1989 Fujino et al. ..... 399/110
5,729,798 A * 3/1998 Yasui et al. ..... 399/122
6,048,676 A * 4/2000 De Leener et al. ..... 206/316.1
6,249,661 B1 * 6/2001 Saitoh et al. ..... 399/117
6,285,845 B1 * 9/2001 Liatard et al. ..... 399/107
6,295,427 B1 * 9/2001 Flick et al. ..... 399/116

* cited by examiner

*Primary Examiner*—Sophia S. Chen
(74) *Attorney, Agent, or Firm*—Lawrence P. Kessler

(57) ABSTRACT

A device for manual replacement and transport of a roller (1) of a copying machine, for example, which makes it easier and safer for service, replacement and transport of hot, heavy and large rollers. There is provided a protective container (5) which can be slipped over a roller (1), which has been released in the machine, and its carrying apparatus. The roller (1) can be removed from the bearing points (L1, L2) of the machine with the protective container (5) using its carrying apparatus which project out of the protective container, and can be inserted into the bearing points. Carrying handles for the carrying apparatus, enable the roller to be guided into slotted openings and, can be radially inserted into bearing points, and can be removed from them. A transport container (6) into which the protective container (5) provided with the roller (1) can be manually inserted and removed.

9 Claims, 4 Drawing Sheets

DEVICE FOR MANUAL REPLACEMENT AND TRANSPORT OF THE ROLLER OF A COPYING MACHINE OR AN ELECTROPHOTOGRAPHIC PRINTER

FIELD OF THE INVENTION

The invention relates to a device for manual replacement and transport of a roller of a copying machine or an electrophotographic printer.

BACKGROUND OF THE INVENTION

Copying machines known in the form of copiers in which a roller is replaceable and transportable for service purposes. The roller can be equipped with a carrying apparatus, in which it can turn freely around its center axis. The copier for its part has rollers for routing through and delivering a toner image-bearing recording medium in the form of a sheet or strip, which rollers can be operated in rotation in an adjoining, axially parallel arrangement in the bearing points of the machine, and are supported by their axial ends. A manually activated device is provided for releasing the rollers in their bearing points and for separating the rollers in the radial direction for purposes of removing them from their hearing points and inserting them into their bearing points.

EP-0 000 631 B1 discloses a copier in which the fixing unit for toner image-bearing sheets of paper can be removed laterally from the copier for service purposes and has a manually actuated swiveling lever system for release of the fixer/heating roller. The fixing/heating roller, for replacement and carrying, has a carrying device in the form of a single U-shaped carrying handle which is located rigidly on a U-shaped holding frame spaced in the middle between the axial ends of the fixing/heating roller and radially to the center axis of the roller. The U-shaped holding frame on its free U-leg ends has one bearing each for one of the axial ends of the roller in which it can be freely turned. Moreover the holding frame on the outside on its free U-leg ends has cube-shaped, separate bearing blocks which are connected rigidly to the leg ends and by which the fixing/heating roller can be inserted into the U-shaped bearing points of the fixing unit and removed.

The problem of this disclosed embodiment is that when using large, heavy fixing/heating rollers, for purposes of improving fixing quality, it is difficult to replace and carry the fixing/heating roller without jamming and damaging by a single carrying handle. Further, removing a hot fixing/heating roller and placing it in the transport container is difficult without endangering the service personnel and damaging the roller.

SUMMARY OF THE INVENTION

Therefore the object of the invention is to provide a device which makes it safer and easier to carry out customer service of the machine, especially replacement and transport of hot, heavy and large rollers, and moreover has a simple, compact, economical structure. The object is achieved by a device including a protective container which can be preferably slipped over a roller which has been released in the device and its carrying apparatus. The roller can then be removed from the bearing points of the device for example with the protective container slipped on by its carrying apparatus which project out of the protective container and can be placed again into the bearing points.

The object is achieved as claimed in the invention with a device as claimed in claim 1 by there being a protective container which can be preferably slipped over a roller which has been released in the device and its carrying means. The roller can then be removed from the bearing points of the device for example with the protective container slipped on by its carrying means which project out of the protective container and can be placed again into the bearing points.

Advantageously the protective container has an essentially U-shaped cross sectional profile with an inside cavity for holding a roller which has a diameter which is larger than one outside diameter of the roller. Accordingly, in the protective container which has been slipped onto the carrying apparatus of the roller, there is no contact between the protective container and the roller. The protective container has recesses in its container wall for holding the carrying apparatus of the roller which has an inside width, which compared to the assigned outside diameter of the carrying apparatus, is predetermined such that the protective container with its recesses can be placed on the carrying apparatus by clamping. There is, moreover, a transport container in which the protective container provided with the roller can be manually inserted and removed. In the transport container there is provided a device for securing the protective container and the roller.

Feasibly there is moreover a transport container in which the protective container provided with the roller can be manually inserted and removed, in the transport container there being means for securing the protective container and the roller.

The invention moreover relates to a copying machine or an electrophotographic printer with an replaceable roller which has on its two axial ends one carrying handle at a time as the carrying apparatus. The roller can be guided by the carry handle into essentially slotted openings which run radially from the outside periphery to the center axis of the bearing points, and which are located on the bearing points of the machine, can be radially inserted into the bearing points, and can be removed from them. Accordingly, it is possible to safely remove the roller from the copier without the danger of injury.

Advantageously, on the one hand the carrying handles are arranged centered to the axial center axis on the ends of the roller. The carrying handles of the roller project axially beyond the bearing points of the device and beyond the protective container. At least one of the two carrying handles of the roller has an arrangement for axial and radial centering and guiding of the roller in its bearing points in the machine. At least one of the two carrying handles of the roller has a guide on the roller for axial and radial centering and guidance of a protective container which may be present.

BRIEF DESCRIPTION OF THE DRAWINGS

The invention will be explained below using the drawings, in which.

DETAILED DESCRIPTION OF THE INVENTION

The following description, according to FIGS. 1 to 4, relates to one preferred embodiment of the device of this invention for manual replacement and transport of the roller of a copying machine. The device here is located on the fixing/heating roller of a fixing unit F, the fixing unit being located in a copying machine of the conventional type (not shown), for example a copier. For one skilled in the art in this field, it goes without saying that the inventive device can also be used in other machines, such as in printers, image transfer units, photoprinters with fixing units and sheet/strip conveyor units or in sheet sorters with sheet conveyor units; and that the rollers can be made in the form of pressure, image transfer or sheet conveyor rollers.

Figure 1:
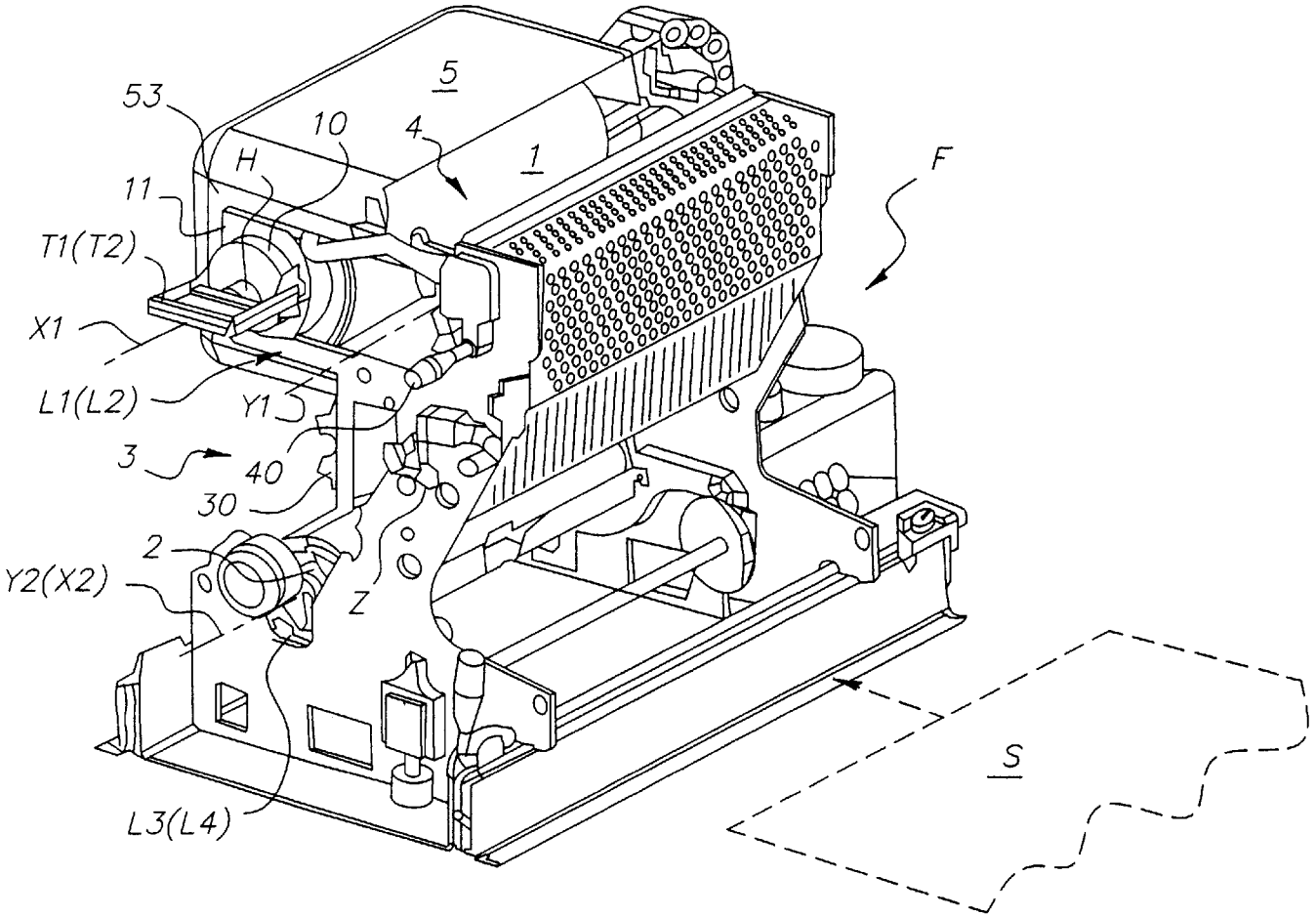
FIG. 1 shows the device, in a three-dimensional representation, providing a protective and handling container on the fixing/heating roller of a fixing unit which has been opened and removed from a copying machine.

The fixing unit F which is shown in FIG. 1 is shown in the position removed laterally from the copier on a carriage of the conventional type (not shown). The unit F is in an opened, upper position which is swiveled around axis Z with its fixing roller 1 by its upper chassis part around axis Z. The fixing unit F here has a fixing roller 1 in the upper part of the chassis and a pressure roller 2 in the lower part of the chassis in a roller pair arrangement for routing through and conveying a recording medium S in the form of a sheet or strip. The rollers (1 and 2) are supported with their axial ends in bearing points L1, L2, L3, and L4 of the chassis parts in an adjoining, axially parallel arrangement so as to be able to operate by rotation in the closed position of the fixing unit.

For purposes of removal of the fixing roller 1 from its bearing points L1, L2 and/or insertion into them, the upper chassis part of the fixing unit may be swiveled to separate the rollers 1 and 2 in the radial direction into the open position of the fixing unit. There is provided a manually activated unit 4 with a toggle lever unit with a handle and with an actuating lever 40 in order to swivel the upper chassis part.

The fixing roller 1 is equipped with carrying apparatus T1, T2 which each have conventional pivot bearings (not shown), and in which the fixing roller is mounted to be able to turn freely around its center axis X1. Furthermore, for purposes of its heating the fixing roller 1 is equipped with a heating lamp H which is attached centered in the roller. The fixing unit F, at the bearing points L1, L2 in the upper part of the chassis has manually activated devices 3 for releasing the fixing roller 1 in its bearing points for purposes of removing it and/or inserting it into its bearing points. The roller 1, as shown in FIGS. 1 to 4, has as the carrying apparatus T1, T2 on its two axial ends respectively one carrying handle, by which the roller can be guided into essentially slotted openings. The slotted openings run radially from the outside periphery to the center axis Y1 of the bearing points and which are located on the bearing points L1, L2 of the machine. As such the roller 1 can be radially inserted into the bearing points and can be removed from them.

Figure 2:
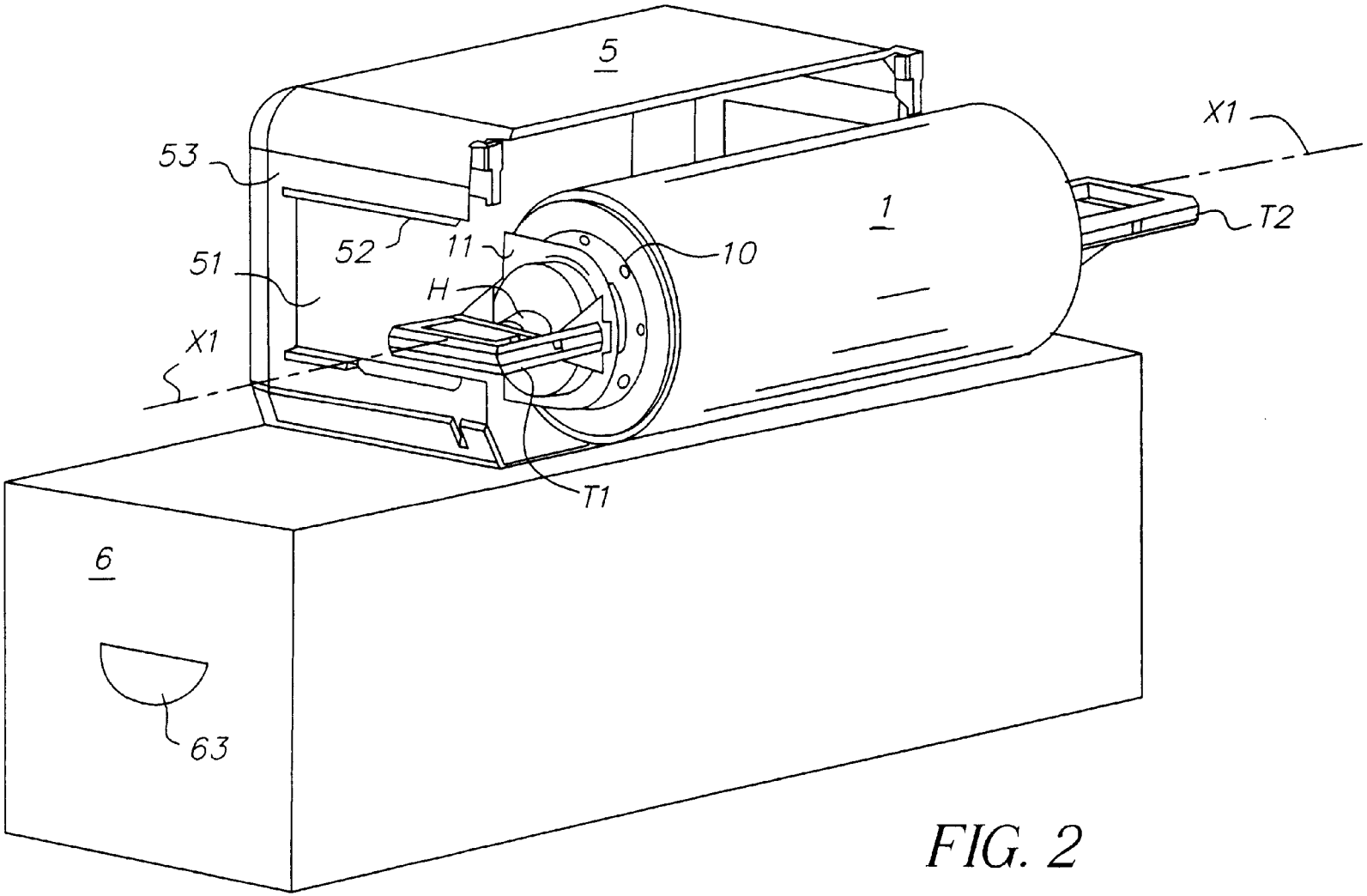
FIG. 2 shows the device from FIG. 1, in an enlarged three-dimensional view, with the fixing/heating roller pushed partially into the protective container and removed from the fixing unit above the transport container.

Furthermore, there is a separate protective container 5 which can be slipped over the roller 1 (or the fixing roller), which has been released in the machine, and its carrying apparatus T1, T2. The roller 1 with the protective container 5 slipped on can be removed from the bearing points L1, L2 of the machine and/or inserted into them by the carrying apparatus T1, T2 which project out of the protective container. The protective container 5 has an essentially U-shaped cross sectional profile with an inside cavity 51 for holding the fixing roller 1. The inside cavity 51 has a diameter which is larger than the outside diameter of the roller 1, such that with the protective container slipped onto the carrying apparatus of the roller there is no contact between the inside walls of the protective container and the roller. Furthermore the protective container 5, as shown in FIGS. 1 and 2, has recesses 52 in its wall 53 for holding the carrying apparatus T1, T2 of the fixing roller 1. The fixing roller 1 has an inside width which compared to the assigned outside diameter of the carrying apparatus is predetermined such that the protective container with its recesses can be placed on the carrying apparatus by clamping. The carrying handles of the carrying apparatus T1, T2 are arranged centered here to the axial center axis X1 on the ends of the fixing roller 1; and the carrying handles project axially beyond the bearing points L1, L2 of the machine or the fixing unit F and beyond the protective container 5. The carrying handles are made in the form of essentially square brackets or eyes. Alternatively, the carrying handles are made as round or oval handles, eyes or knobs.

The protective container 5 has on its two ends (or axially located side walls 53) essentially slotted recesses 52 for holding the center/guiding/holding device 11 of the carrying handles, which are located on the axial ends of the roller 1. The inside width of the recesses 52 is matched relative to the assigned outside diameters of the center/guiding/holding device 11 such that the protective container 5, with its side walls 53 or recesses 52, can be clamped thereon. Here the slotted recesses 52 for the device 11, on the side walls 53 of the protective container 5, are arranged centered to the axial center axis of the inside cavity 51 of the U-shaped protective container. The recesses and the inside cavity 51 have identical radial alignments for slipping the protective container onto the fixing roller 1 and for removing it therefrom. The protective container 5 is made, for example, of a spring-elastic, thermally resistant and insulating plastic material.

Figure 3:
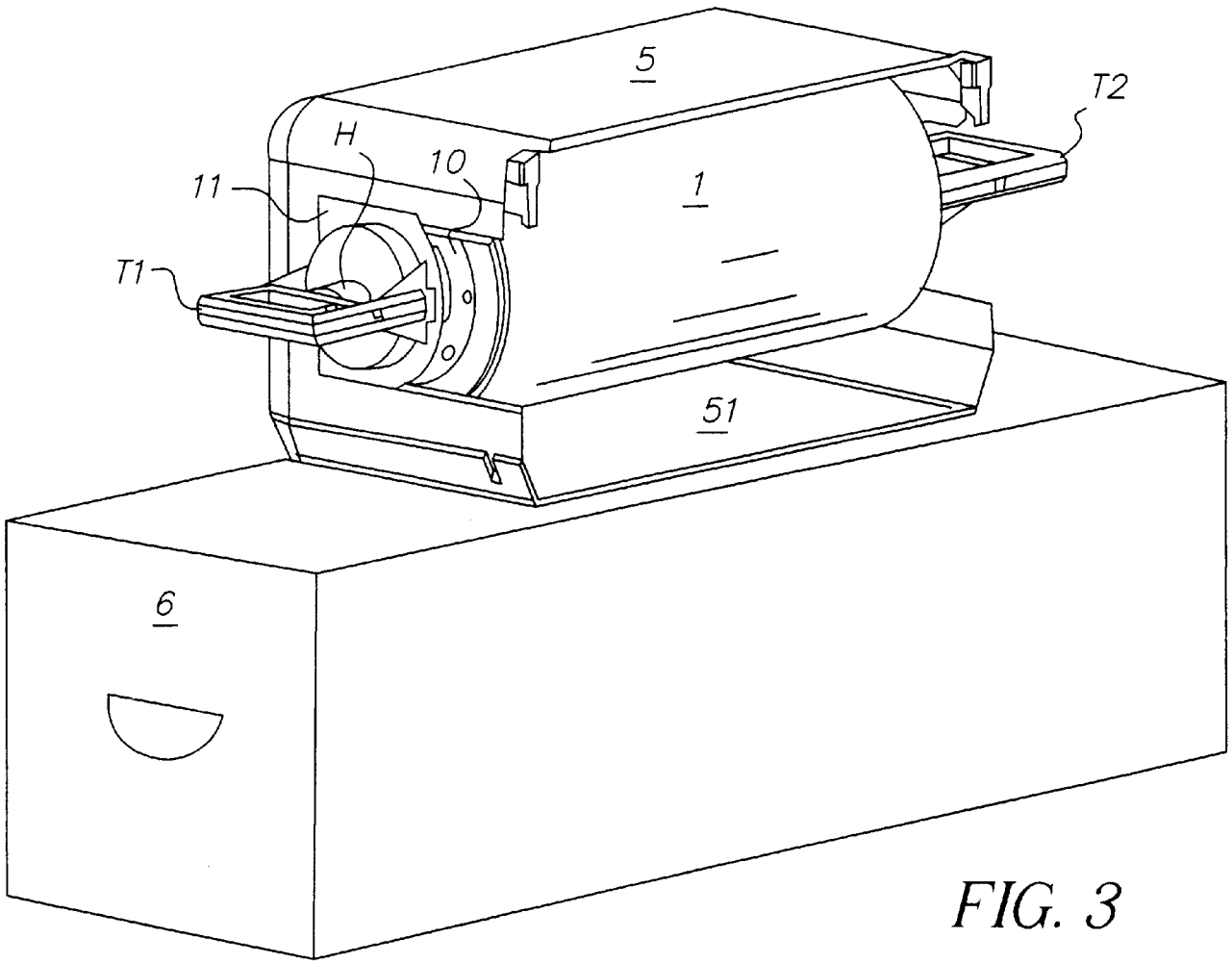
FIG. 3 shows the device from FIG. 2 with the fixing/heating roller inserted into the protective container above the transport container.

As shown in FIGS. 1 to 3, the two carrying handles of the carrying apparatus T1, T2 of the fixing roller 1 has device 10 for axial and radial centering, guiding and holding of the roller 1 in its bearing points L1, L2 in the machine or in the fixing unit F. Further, the handles have device 11 for axial and radial centering, guiding and holding of the protective container 5 on the roller 1 or on the carrying apparatus T1, T2. The devices 10 and 11, located on the carrying handles, serve for axial and radial centering, guiding and holding of the fixing roller 1 in the bearing points L1, L2 of the fixing unit F and in the recesses 52 of the protective container 5 are combined and made integral. The devices 10 and 11 are in the form of annular disks which are located concentrically around the center axis X1 of the fixing roller 1. One disk at a time is located in the area of each axial end of the roller 1 and spaced away from it.

The two devices 10 for centering, guiding and holding of the fixing roller 1 in the bearing points L1, L2 are made as essentially round annular disks which when the fixing roller is inserted into the bearing points L1, L2 are each inserted into one annular groove (not shown) of the bearing points. The carrying handles are inserted into radially running slotted recesses or openings of the bearing points so that they are secured against twisting. Only the fixing roller 1 can turn freely in its pivot bearings which are contained in the carrying device, for example, in conventional ball bearings. The two devices 11 for centering, guiding and holding of the protective container 5 are found as a rectangular area on the annular disks, which area runs radially to the outside, away from the bearing points L1, L2 and lengthwise along the slotted guides of the bearing points. After releasing the fixing roller 1 in its bearing points L1, L2 by an unlocking/locking lever 30, the protective container 5 can be slipped by its grooves in the recesses 52 of the side walls 53 onto this rectangular area of the two annular disks of the carrying apparatus T1, T2.

Figure 4:
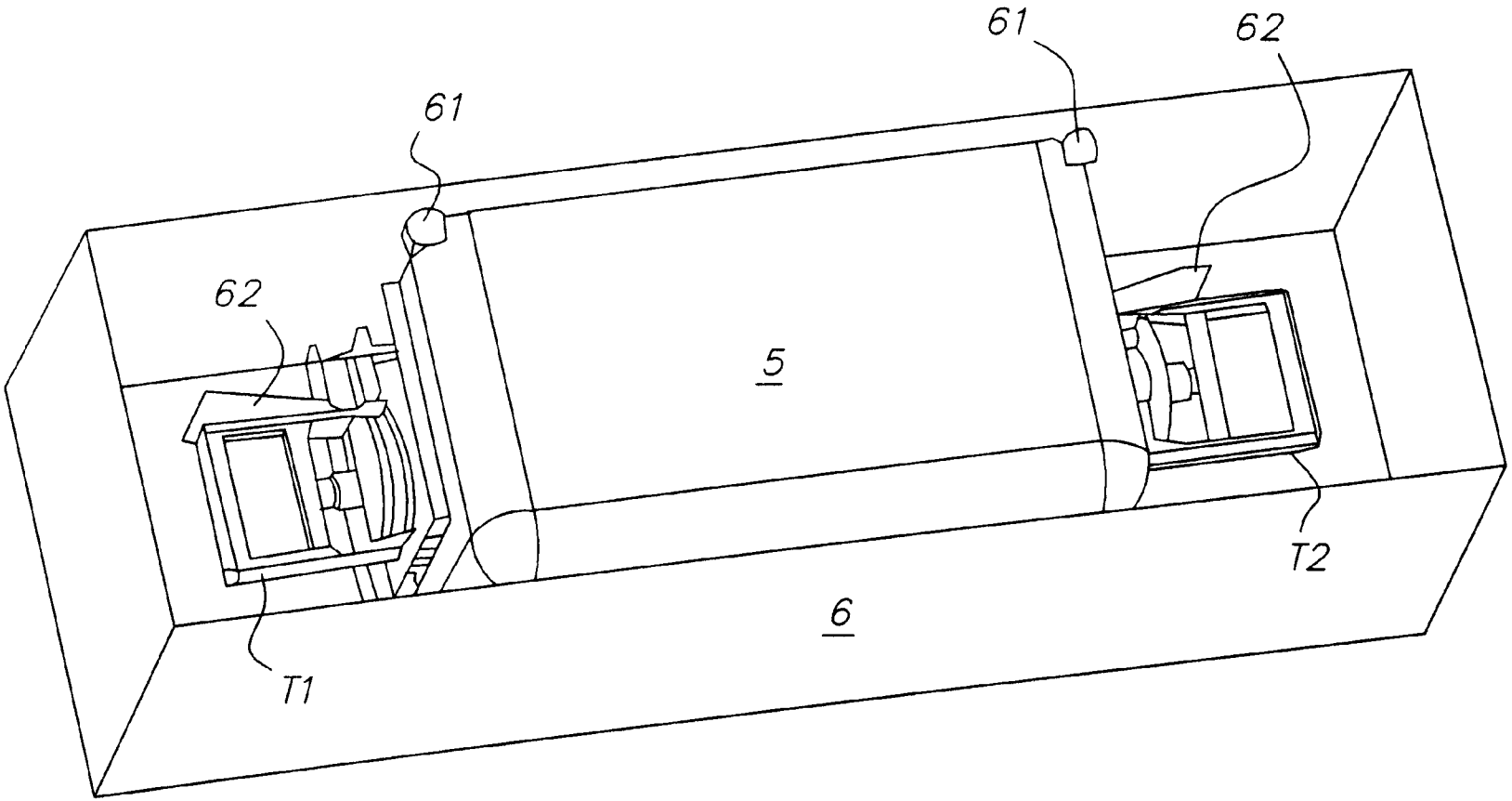
FIG. 4 shows the device from FIG. 3, in a three-dimensional view from the top with the protective container which contains a fixing/heating roller and which has been inserted into the transport container.

To transport the fixing roller 1, as shown in FIGS. 2 to 4, there is a transport container 6 with two handles 63 on the side walls. The protective container 5, which is provided with the fixing roller, can be manually inserted and removed from the transport container 6. The transport container includes devices 61, 62 for securing the protective container and the roller. As shown in FIG. 4, the devices 62, located on the bottom of the transport container for securing the protective container 5 for the fixing roller 1, engage the carrying handles of the carrying apparatus. The devices 62 act against the securing devices 61 of the protective container 5, which are located on the lengthwise wall of the transport container. The devices 61, 62 for securing the roller and the protective container are made spring-elastic, the devices 62 being made in the form of a spring clip and the devices 61 being made in the form of retaining pins on which the eyes of the protective container 5 can be slipped. Alternatively, the transport container may have several securing device assemblies for holding several rollers 1 with respective protective containers. Part list L1 first bearing point/s for 1st roller (fixing/heating roller) in the fixing unit
L2 second bearing point/s for 1st roller (fixing/heating roller) in the fixing unit
L3 first bearing point/s for 2nd roller (pressure roller) in the fixing unit
L4 second bearing point/s for 2nd roller (pressure roller) in the fixing unit
F fixing unit
H heating lamp of 1st roller
S recording medium/sheet or strip (paper, film, etc.)
T1 first carrying handle/s of carrying apparatus of the 1st roller
T2 second carrying handle/s of carrying apparatus of the 1st roller
T2 second carrying handle/s of carrying means of the 1st roller
X1 center axis of 1st roller
X2 center axis of 2nd roller
Y1 center axis of the bearing point for the 1st roller
Y2 center axis of the bearing point for the 2nd roller
Z swiveling axis of the top and bottom chassis parts of the fixing unit
1 first/top roller (fixing/heating roller) of the fixing unit
2 second/bottom roller (fixing/heating roller) of the fixing unit
3 device for releasing (locking/unlocking) the rollers in the bearing points
4 device for radially separating (pressing together) the rollers in the fixing unit
5 protective container/handling container for slipping onto the rollers
6 transport container for the roller/s with protective container
10 device on carrying handle/s of the 1st roller for axial/radial centering/guiding of the 1st roller in the bearing points of the fixing unit
11 device on carrying handle/s of the 1st roller for axial/radial centering/guiding of the protective container
30 unlocking/locking lever of the release device on the bearing points
40 actuating lever of the separating device/swiveling device for the rollers
51 inside cavity of the protective container
52 recess/es in the side wall/s of the protective container
53 side wall/s of the protective container
61 securing device for the protective container in the transport container
62 securing device for the rollers in the transport container
63 handle/s on the transport container The invention has been dscriped in detail with particular reference to certain preferred embodiment thereof, but it will be understood that variations and modifications can be effected within the spirit and scope of the invention.

We claim:

1. Device for manual replacement and transport of a roller (1) of a copying machine or an electrophotographic printer, said roller being equipped with carrying apparatus, wherein a protective container (5) is provided which can be slipped over a roller (1), which has been released in said copying machine, and its carrying apparatus (T1, T2), said protective container (5) having recesses (52) in its container wall (53) for holding said carrying apparatus (T1, T2), said recesses having an inside width which compared to an outside of the carrying apparatus is predetermined such that said protective container with its recesses is located on said carrying apparatus by clamping; and said roller (1), together with said protective container (5) can be removed from said copying machine by said carrying apparatus (T1, T2) which can be inserted into said roller, and project out of the protective container.

2. Device as claimed in claim 1, wherein said protective container (5) has an essentially U-shaped cross-sectional profile with an inside cavity (51) for holding said roller (1), which cavity has a diameter which is larger than one outside diameter of the roller, such that in said protective container which has been slipped onto said carrying apparatus of said roller there is no contact between said protective container and said roller.

3. Replaceable roller for a copying machine or an electrophotographic printer, wherein said roller (1) has on its two axial ends respectively one carrying handle each as a carrying apparatus (T1, T2), by which said roller can be guided into essentially slotted openings located on bearing points (L1, L2) for said roller of said copying machine, said slotted openings extending radially from an outside periphery to a center axis (Y1) of said bearing points, said carrying handles of said roller (1) have a device (10) for axial and radial centering, guiding and holding of said roller in its bearing points (L1, L2) in said copying machine; said carrying handles of said roller (1) have a device (11) for axial and radial centering, guiding and holding of a protective container (5) on said roller; and said carrying handles are in the form of square, round or oval handles, eyes or knobs whereby said roller is radially inserted into the bearing points and can be removed from them.

4. Replaceable roller as claimed in claim 3, wherein said carrying handles are arranged, centered with respect to the axial center axis (X1) on the ends of the roller (1); and said carrying handles of said roller project axially beyond said bearing points (L1, L2) of said copying machine.

5. Replaceable roller as claimed in claim 4, wherein said devices (10, 11) for axial and radial centering and guiding of said roller (1) in said bearing points (L1, L2) of said copying machine, and in recesses (52) provided in said protective container (5), are combined and made integral, and are located on said carrying handles.

6. Device for manual replacement and transport for a replaceable roller as claimed in claim 5, wherein said protective container (5) on its two axially located side walls (53) has slotted recesses (52) for holding said center/guiding devices (11) of the carrying handles, said center/guiding devices (11) being located on the axial ends of said roller (1); and wherein said slotted recesses have an inside width matched relative to an outside of said center/guiding devices (11) such that said protective container (5) with its side walls (53) are clamped thereon.

7. Device as claimed in claim 6, wherein said slotted recesses (52) for said certer/guiding devices (11) on said side walls (53) of protective container (5) are arranged centered to an axial center axis for an inside cavity of said protective container; and said recesses and the inside cavity have identical radial alignments for slipping said protective container onto said roller (1) and for removing it therefrom.

8. Copying machine or electrophotographic printer with a replaceable roller, wherein said roller (1) has on its two axial ends respectively one carrying handle each as a carrying apparatus (T1, T2), by which said roller can be guided into essentially slotted openings located on bearing points (L1, L2) for said roller of said copying machine, said slotted openings extending radially from an outside periphery to a center axis (Y1) of said bearing points, said carrying handles of said roller (1) have a device (10) for axial and radial centering, guiding and holding of said roller in its bearing points (L1, L2) in said copying machine; said carrying handles of said roller (1) have a device (11) for axial and radial centering, guiding and holding of a protective container (5) on said roller; and said carrying handles are in the form of square, round or oval handles, eyes or knobs whereby said roller is radially inserted into the bearing points and can be removed from them.

9. Transport container for a replaceable roller, wherein there is provided a protective container (5) to which a roller (1) can be manually inserted and removed, and, in such a transport container there are devices (61; 62) for securing the protective container and the roller therein, said device (62) for securing said roller (1) engage carrying handles for said roller (1), and act against said device (61) for securing said protective container (5); and said devices (61, 62) for securing the roller and the protective container are made spring-elastic.

* * * * *